United States Patent [19]

Dill

[11] 4,208,172

[45] Jun. 17, 1980

[54] MARINA SIPHON DEVICE

[76] Inventor: Richard G. Dill, Rte. 1, Box 103, Penhook, Va. 24137

[21] Appl. No.: 884,435

[22] Filed: Mar. 8, 1978

[51] Int. Cl.[2] ..... F04F 5/42

[52] U.S. Cl. ..... 417/171; 417/181; 417/183

[58] Field of Search ..... 417/171, 181, 151, 183, 417/184, 194, 196

[56] References Cited

U.S. PATENT DOCUMENTS

| | | | |
|---|---|---|---|
| 49,602 | 8/1865 | Brear | 417/151 |
| 615,992 | 12/1898 | Jones | 417/183 |
| 842,100 | 1/1907 | Linderstramm | 417/151 |
| 995,969 | 6/1911 | Junk | 417/181 |
| 1,826,829 | 10/1931 | Scott | 417/181 |
| 2,479,783 | 8/1949 | Sawyer et al. | 417/151 |

FOREIGN PATENT DOCUMENTS

| | | | |
|---|---|---|---|
| 27551 | 10/1906 | Austria | 417/151 |
| 345691 | 12/1921 | Fed. Rep. of Germany | 417/194 |
| 713410 | 10/1931 | France | 417/151 |
| 196526 | 4/1923 | United Kingdom | 417/181 |
| 575024 | 1/1946 | United Kingdom | 417/194 |

*Primary Examiner*—Carlton R. Croyle
*Assistant Examiner*—Edward Look
*Attorney, Agent, or Firm*—Staas & Halsey

[57] ABSTRACT

A siphon device for use around marinas and the like for siphoning large volumes of water containing debris and foreign matter without clogging thereof. The siphon includes an ell member having an input and an output opening of the same size, a hydraulic pressure input stub member along the larger outer curved portion of the ell and a nozzle element extending only a short way thereinto. The hydraulic pressure input nozzle element being of approximately one-fourth the diameter of the ell input and output openings and provided with diagonal or spiral grooves internally thereof for effecting a swirling action of fluid inputted thereto under high pressure.

7 Claims, 3 Drawing Figures

MARINA SIPHON DEVICE

BACKGROUND OF THE INVENTION

1. Field of the Invention

This invention relates generally to a device for transferring and removing large quantities of water from areas around marinas, such as sunken boats and the like, while permitting foreign debris to pass therethrough without clogging thereof.

2. Description of the Prior Art

Devices for normally siphoning liquids are generally susceptible to clogging when the liquid being siphoned is contaminated with foreign matter.

Another problem with known type siphon devices is that they often times are not self priming and are therefore not suitable for use in marine type applications.

Known prior art patents which may be pertinent to this invention are as follows: U.S. Pat. Nos. 2,631,774; 1,729,577; 1,791,292; 2,044,088; 2,375,180; 3,185,107; 3,167,639; 2,616,614.

The U.S. Pat. No. 2,631,774 provides the common type garden hose concept, which is quite widely known and used, but has the disadvantage of being easily and rapidly clogged. Also, most of the garden hose varieties must be primed.

None of these known prior art devices offers the new and unique features of the invention disclosed herein.

SUMMARY OF THE INVENTION

An object of the present invention is to provide a siphon device for use around marinas and the like which will be self priming and substantially non-clogging.

Another object of this invention is to provide an ell shaped siphon having the input opening of the same large size as the output opening thereof, and with a high pressure substantially smaller area grooved nozzle stub providing the operating effect and for pulling a substantial vacuum with the overall siphon device.

A further object of this invention is to provide a high volume, high suction effect marine type siphon which is relatively non-clogging.

The invention disclosed herein is of a marine siphon device having a large ell member with substantial size input and output openings. A smaller opening input stub member is integrated with the curved portion of the ell. A nozzle element is mounted and secured within the stub member. This nozzle element extends just slightly into the interior of the ell member and provides the operating force by the flow of high pressure liquid therethrough. A plurality of grooves are provided internally of the nozzle element. These grooves are arranged at an angle to the longitudinal axis of the nozzle to provide a rotation and swirling effect to the stream of liquid as it leaves the nozzle and enters the siphon ell. This has a number of very desirable results which include the ability to pull a very high vacuum (up to 22 inches), a high volume ratio of approximately 8 to 1, and a relatively non-clogging by debris and foreign matter siphon device.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
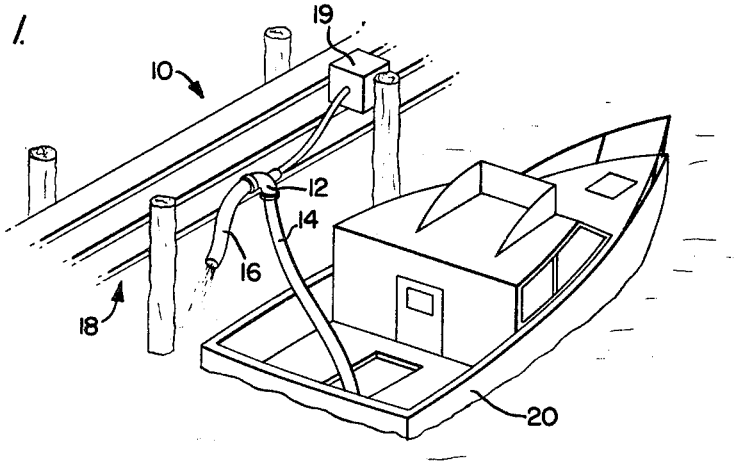
FIG. 1 is a perspective view of the siphon device of this invention as in use.

Referring to FIG. 1 of the drawings, reference numeral 10 indicates in general the siphon of this invention as in use. The main siphon body ell 12 has an appropriate input and suction hose 14 connected thereto and another appropriate output and discharge hose 16. A dock 18 is shown which has associated therewith the high pressure liquid pump 19 and a portion of a sunken boat 20. The high pressure liquid pump 19 may obtain water from the area associated with the dock such as a river, bay, lake, etc., or it may obtain liquid from any other suitable source. Also, a high pressure on-shore facility for supplying the liquid pressure may be utilized.

Figure 2:
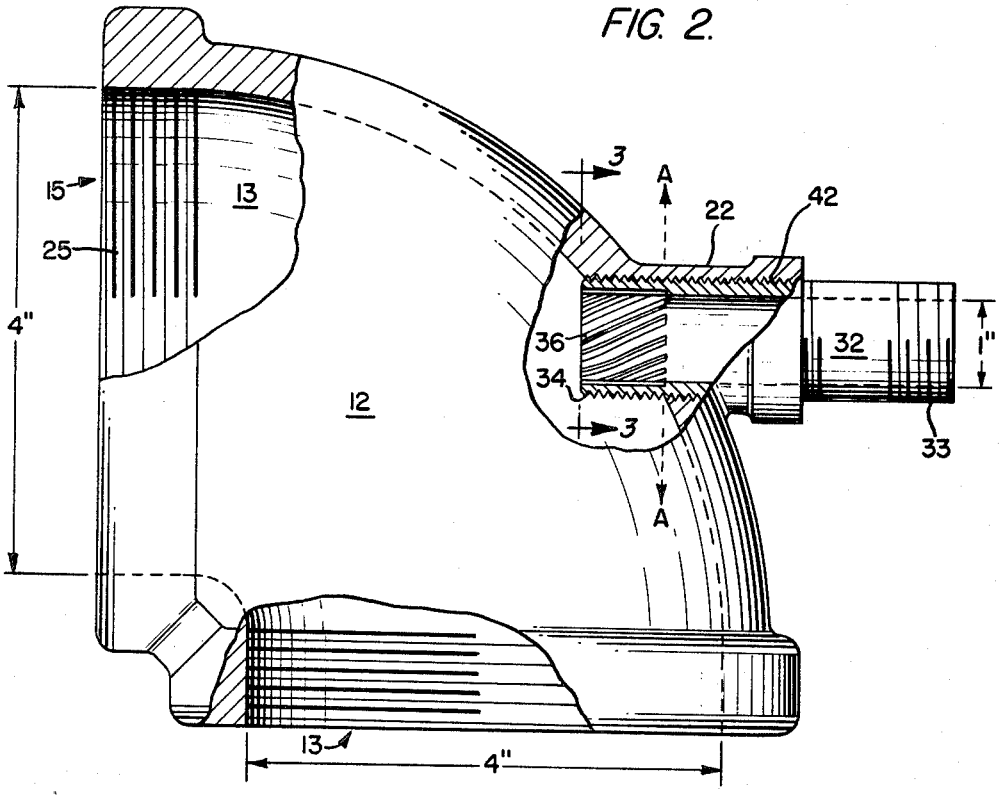
FIG. 2 is a side elevational view of the siphon of this invention.
Figure 3:
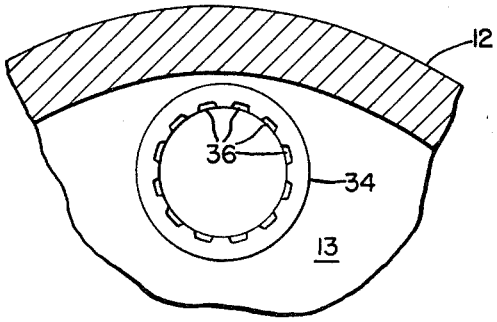
FIG. 3 is a cross-sectional view taken along line 3—3 of FIG. 2.

FIG. 2 shows the basic structure of the siphon. A main body ell of substantial size 12 is provided. An input opening 13 of at least 4 inches in diameter is preferred, with an output opening 15 of similar equal size. Opening 13 is provided with internal threads 23 for connection to the suction hose 14. Similarly, opening 15 is provided with internal threads 25 for connection to the discharge hose 16. The inside surface 13 of the ell member is substantially smooth and projection free. It is important to provide a smooth internal surface so that foreign material and debris will not tend to be caught therein. A stub member 22 is provided along the greater outer circumference of the ell member or supporting a short nozzle element 32 of substantially smaller size than the main siphon ell. Preferably the stub member 22 is made integral with the body ell 12. The short nozzle 32 is preferably removably mounted within the integral stub member 22 by screw threads 42 as shown. However, it may also be secured by welding, epoxy adhesive, or the like. Normally the outside tip end of the nozzle element will also be provided with external threads 33 for attachment of an appropriate coupling hose to the source of high pressure input liquid. The other end 34 of the nozzle element is provided internally with short grooves 36 extending from the tip inwardly of the nozzle for ¾ to 2 inches thereof, in a spiral or angle to the nozzle longitudinal axis. These grooves 36 provide a swirling and twisting effect to the output of the high pressure liquid being fed through the nozzle element 32 into the interior of the ell member 12.

Preferably, at most only a very short portion of the nozzle 32 will extend into the ell, and in some cases it may be desirable to terminate the nozzle along the dotted lines A—A of FIG. 2. This being for the purpose of offering no obstructions whatsoever to the passage of foreign matter and debris through the overall siphon. That is, with the nozzle element 32 only being positioned within stub member 22 to the extent that the leading edge of end 34 is flush with the internal surface 13 of the body ell 12. It has been found that an internal diameter of 1 inch for the nozzle 32 in relation to the 4 inch internal diameter for the ell member is the best for maximum overall performance of the siphon device.

In use, the input 13 of the ell is connected to suitable input pipe or hose structure 14 which is in turn inserted into the area to be siphoned. Another suitable output hose or pipe 16 is connected to the output portion 15 of the ell. These hoses are of such length as to provide the discharge over the side of a sunken vessel, or external of a flooded basement or other area to be pumped out. Once the input and output hoses are suitably arranged, then through a high pressure liquid input hose coupled to the short input nozzle 32, high pressure liquid is fed into the siphon. By means of the slanted spiral grooves 36 internal of the nozzle a swirling and twisting discharge of the high pressure liquid is effected within the ell. This creates a tremendous high vacuum suction at the input 13 which rapidly pulls the liquid to be pumped up through the ell and out thereof. The siphon device of this invention is entirely self priming, and substantially clogging free.

It should be noted that the central longitudinal axis of the nozzle 32 is substantially in line with the central axis of output opening 15, and substantially at right angles to the central axis of input opening 13. This is important for the desired results of this improved siphon device when put into use.

While primarily designed for use around marinas for raising sunken boats and the like, this siphon device also may have application for use by firemen, etc. for pumping out flooded basements, and other such areas requiring high volume pumping with non-clog type action.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A siphon device for use around marinas and the like for pumping water containing large size debris without clogging comprising an ell body member of substantial size, said ell body member having a large size input opening, a large size output opening of the same size as the input opening, a substantially smaller high pressure liquid input area between the input and the output openings and along the outer largest circumferential surface thereof, said area of high pressure liquid input including an integral stub member extending outwardly of the ell body member and having the central axis thereof substantially in alignment with the central axis of the output opening, said integral stub member being provided with internal threads for adjustable reception of a short high pressure input nozzle therewithin, a short externally threaded high pressure input nozzle securably mounted within the integral stub member, and said short nozzle being provided with internal grooves along the inside of the end which is inside the stub member, said internal grooves being at an angle of approximately 30° to the central axis of the nozzle so as to create a swirling and twisting effect to the high pressure liquid being fed therethrough.

2. The structure as set forth in claim 1, wherein the high pressure input nozzle is a pipe nipple with approximately a 1 inch inside diameter, and the said input and output openings of the ell body member have at least a 4 inch inside diameter.

3. The structure as set forth in claim 2 together with an input hose of non-collapsible type connected to the input opening of said ell body member.

4. The structure as set forth in claim 3, together with an output discharge hose connected to the output opening of the ell body member.

5. The structure as set forth in claim 1, wherein the short adjustable high pressure input nozzle projects a short distance into the interior of said ell body member.

6. The structure as set forth in claim 1, wherein the short adjustable high pressure nozzle does not project into the inside area of the ell body member at all, but its innermost edge terminates just short of the inner circumference of the outer curved portion of said ell body member so that no obstructions whatsoever are present inside of the ell body member to debris passing therethrough.

7. The structure as set forth in claim 1, wherein said internal grooves at an angle of approximately 30° to the central axis of the nozzle are so angled as to produce a counterclockwise swirling effect as viewed from the large size output opening of the ell body member.

* * * * *